United States Patent [19]

Manzione

[11] Patent Number: 5,040,799

[45] Date of Patent: Aug. 20, 1991

[54] GOLF CUP PUTTING AID

[76] Inventor: Peter Manzione, P.O. Box 96, Factoryville, Pa. 18419

[21] Appl. No.: 636,105

[22] Filed: Dec. 31, 1990

[51] Int. Cl.[5] ..... A63B 69/36

[52] U.S. Cl. ..... 273/184 A; 273/177 B; 273/DIG. 24

[58] Field of Search ..... 273/177 R, 177 A, 177 B, 273/178 R, 184 R, 184 A, 185 R, 127 B

[56] References Cited

U.S. PATENT DOCUMENTS

D. 164,166 8/1951 Griswold ..... 273/177 R X 3,033,571 5/1962 Botts ..... 273/177 A X 3,649,029 3/1972 Worrell ..... 273/DIG. 24

4,936,583 6/1990 Peabody et al. ..... 273/177 R

*Primary Examiner*—George J. Marlo

*Attorney, Agent, or Firm*—Richard L. Miller

[57] ABSTRACT

A golf cup putting aid is provided and consists of a thin walled flexible disc target having a size and shape intended to duplicate the actual size and shape of a real golf hole, and designed so as to lie as flat as possible on a suitable surface, a mechanism on the flexible disc target for trapping a golf ball thereon and indicia on the flexible disc target, for replacing a nondescript visual image.

2 Claims, 1 Drawing Sheet

GOLF CUP PUTTING AID

BACKGROUND OF THE INVENTION

The instant invention relates generally to the game of golf and more specifically it relates to a golf cup putting aid.

Numerous golf putting devices have been provided in the prior art that are adapted to help the golfer in practicing putting golf balls while away from the golf course. While these units may be suitable for the particular purpose to which they address, they would not be as suitable for the purpose of the present invention as hereafter described.

SUMMARY OF THE INVENTION

A primary object of the present invention is to provide a golf cup putting aid that will overcome the shortcomings of the prior art devices.

Another object is to provide a golf cup putting aid that as accurately as possible simulates the actual size, shape and trapping action of a real golf hole, while at the same time it replaces the real holes nondescript nature with a striking visual image.

An additional object is to provide a golf cup putting aid so that the user will have an accurately sized target with which to practice the mechanical skills associated with putting, while at the same time, heighten the visual stimulant to the user, allowing the user to improve the mental skills associated with putting.

A further object is to provide a golf cup putting aid that is simple and easy to use.

A still further object is to provide a golf cup putting aid that is lie as flat as possible on any surface.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWINGS FIGURES

The figures in the drawings are briefly described as follows.

DETAILED DESCRIPTION OF THE PREFERRED EMBODIMENTS

Figure 3:
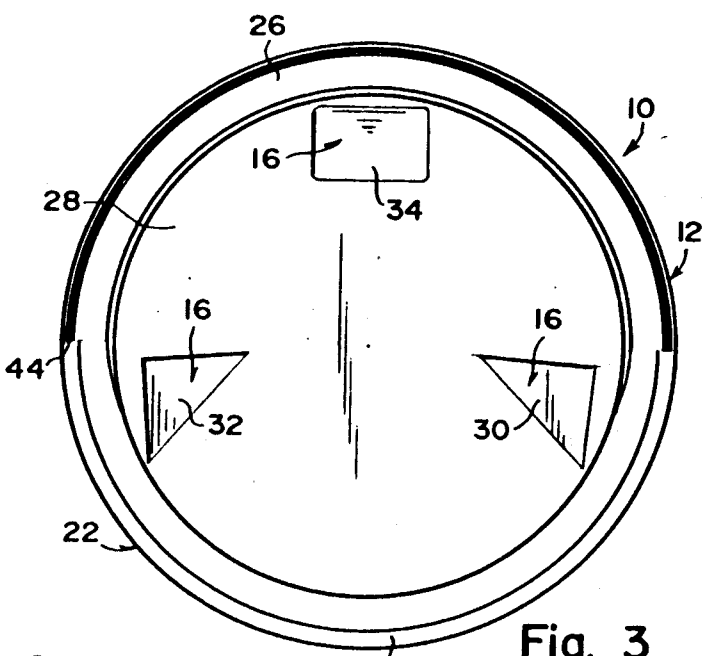
FIG. 3 is a bottom view of the instant invention taken in direction of arrow 3 in FIG. 1.
Figure 2:
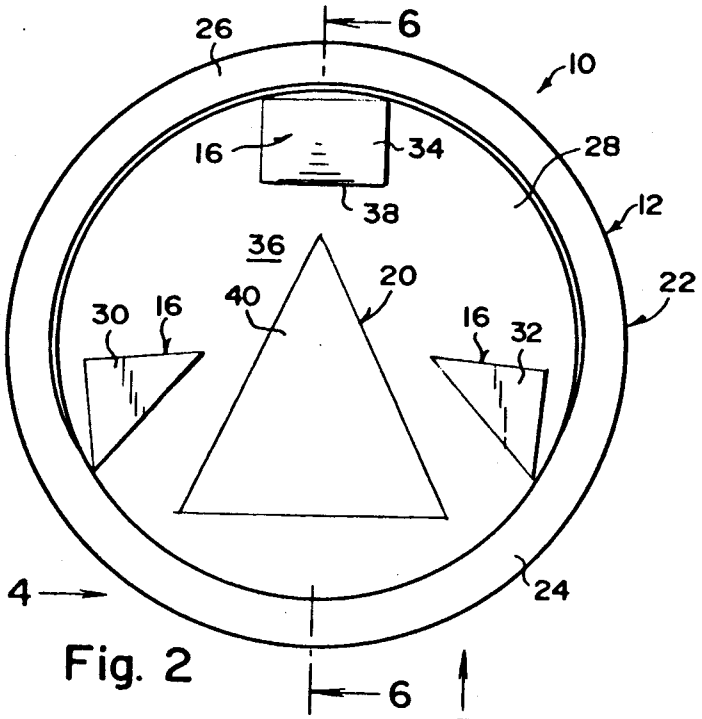
FIG. 2 is a top view of the instant invention taken in direction of arrow 2 in FIG. 1.
Figure 1:
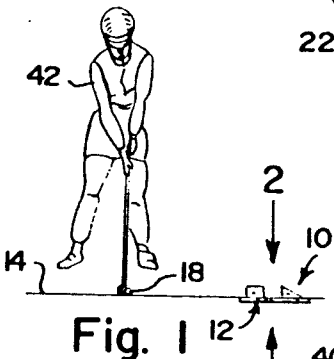
FIG. 1 is a diagrammatic perspective view showing a golfer using an exaggerated enlarged version of the instant invention.
Figure 5:
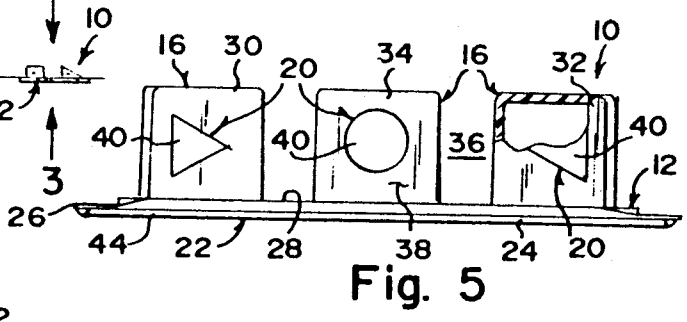
FIG. 5 is a front elevational view taken in the direction of arrow 5 in FIG. 2.
Figure 4:
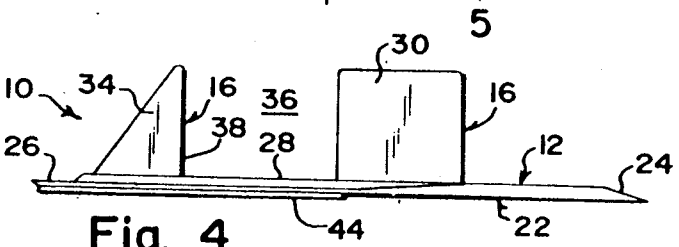
FIG. 4 is a side elevational view taken in the direction of arrow 4 in FIG. 2.
Figure 6:
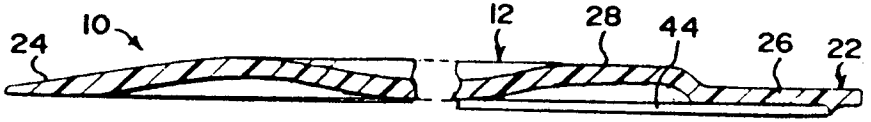
FIG. 6 is an enlarged cross sectional view with parts broken away taken on Line 6—6 in FIG. 2.

Turning now descriptively to the drawings, in which like reference characters denote similar elements throughout the several views, the Figures illustrate a golf cup putting aid 10, typically but not necessarily molded in a single thin walled piece out of an elastomer, consisting of a flexible disc target 12 having a size and shape intended to duplicate the actual size and shape of a real golf hole, and designed so as to lie as flat as possible on a suitable surface 14, such as a carpet. A trapping mechanism 16 is positioned on the flexible disc target 12, for trapping a golf ball 18 thereon. Indicias 20 are marked on the flexible disc target 12 for replacing the nondescript nature of the real golf hole with a striking visual image. A semi-circular rim 44 is provided to help prevent the golf cup putting aid 10 from sliding backward at impact, on the surface 14.

The flexible disc target 12 includes an outer portion 22 being an outside perimeter of the disc target 12, having an unsupported front thin walled incline ramp segment 24 to allow the golf ball 18 travelling at a proper velocity to enter with minimum resistance into the disc target 12 and a rear segment 26 which contacts the suitable surface 14 to provide stabilization to the flexible disc target 12 as the golf ball 18 enters the disc target 12. An inner portion 28 is also provided, being a raised center section having a concave configuration to help trap the golf ball 18 when the golf ball 18 is travelling at a minimum velocity and enters the disc target 12, without enough force to become trapped in trapping mechanism 16.

The trapping mechanism 16 includes three triangular polyhedron barriers 30, 32 and 34 integral with the inner portion 28 of the disc target 12. The angular positioning of the left and right barriers 30 and 32 with respect to the rear center barrier 34 creates an opening slightly smaller than the diameter of the golf ball 18. The golf ball 18 will become trapped in the center scoring area 36 when it travels on an acceptable line at the proper velocity between the left and right barriers 30 and 32 and hits against the flat surface 38 of the rear center barrier 34.

The striking visual image indicias 20 include a plurality of florescent and phosphorescent markings 40 placed onto a surface of each of the polyhedron barriers and on the inner portion of the disc target to indicate a center scoring area 36, while providing a strong focal point for the user 42 of the golf putting aid 10 to improve hand and eye skills associated with putting, especially in the dark.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A golf cup putting aid which comprises:

(a) a thin walled flexible disc target having a size and shape corresponding to the actual size and shape of a real golf hole;

(b) means, on said flexible disc target, for trapping a golf ball thereon;

(c) means, on said flexible disc target, for enhancing its visual image; and (d) means to permit said flexible disc target to lie substantially flat on a suitable surface, said flexible disc target including (e) an outer portion being an outside perimeter of said target and having a front thin walled inclined ramp segment to allow the golf ball travelling at a proper velocity to enter into said disc target with minimum resistance and a rear rim segment which contacts the suitable surface to provide a resistance which prevents the flexible disc target from moving backward as the golf ball enters said target; and (f) an inner portion being a raised center section having centrally thereof a concave scoring portion to help trap the golf ball when the golf ball is travelling at a minimum velocity and enters said disc target, without enough force to become lodged in a trapping means, and said trapping means including three triangular polyhedron barriers integral with said inner portion of said disc target to provide left and right barriers and a rear center barrier, which left and right barriers create an opening slightly smaller than the diameter of the golf ball and leading to said rear barrier so that the golf ball will become trapped in the center scoring area when it travels on an acceptable line at the proper velocity between said left and right barriers and hits against the flat surface of said rear center barrier.

2. A golf cup putting aid as recited in claim 1, wherein said means for enhancing its visual image includes a plurality of florescent and phosphorescent marking placed on a surface of said polyhedron barriers and on said inner portion of said disc target to indicate the center scoring area, while providing a strong focal point for the user of said golf cup putting aid to improve hand and eye skills associated with putting, especially in the dark.

* * * * *